US006007010A

United States Patent [19]

Kuchersky et al.

[11] Patent Number: 6,007,010

[45] Date of Patent: Dec. 28, 1999

[54] CENTRIFUGAL GRINDER

[76] Inventors: Nikolai Ivanovich Kuchersky, ul, Shevchenko, d.6, kv.2, Navoi 706800, Uzebkistan; Evgeny Alexeevich Averochkin, ul. V. Nevskogo, d. 17, kv.80, Voronezh 394086, Russian Federation; Gennady Alexeevich Prokhorenko, 11-i microregion, d. 12, kv.46, Zarafshan 706801, Uzebkistan; Alexandr Nikolaevich Lukyanov, ul. Academician Zelinskogo, d.38, korp.8, kv.42, Moscow 117334, Russian Federation; Viktor Nikolaevich Sytenkov, 11-i microregion, d.27a, kv.3, Zarafshan 706801, Uzebkistan

[21] Appl. No.: 09/029,623

[22] PCT Filed: Dec. 9, 1996

[86] PCT No.: PCT/RU96/00339

§ 371 Date: Mar. 30, 1998

§ 102(e) Date: Mar. 30, 1998

[87] PCT Pub. No.: WO98/01224

PCT Pub. Date: Jan. 15, 1998

[30] Foreign Application Priority Data

Jul. 4, 1996 [RU] Russian Federation ..... 96113891
Jul. 4, 1996 [RU] Russian Federation ..... 96113894

[51] Int. Cl.[6] ..... B02C 2/04

[52] U.S. Cl. ..... 241/275; 241/300

[58] Field of Search ..... 241/275, 291, 241/300

[56] References Cited

U.S. PATENT DOCUMENTS

| | | | |
|---|---|---|---|
| 2,339,735 | 1/1944 | Smith | 21/61 |
| 2,529,679 | 11/1950 | Dodds | 146/221.7 |
| 2,645,345 | 7/1953 | Dodds | 209/138 |
| 3,162,382 | 12/1964 | Danyluke | 241/53 |
| 3,902,673 | 9/1975 | Berggren | 241/246 |
| 3,926,380 | 12/1975 | Musgrove et al. | 241/248 |
| 4,515,316 | 5/1985 | Kawaguchi | 241/5 |
| 4,667,887 | 5/1987 | Kawaguchi | 241/24 |
| 5,791,571 | 8/1998 | Hijikata | 241/188.2 |

FOREIGN PATENT DOCUMENTS

| | | |
|---|---|---|
| 0 076 216 | 4/1983 | European Pat. Off. . |
| 1208398 | 9/1959 | France . |
| 1143692 | 7/1957 | Germany . |
| 1 296 936 | 6/1969 | Germany . |
| 622491 | 7/1978 | Russian Federation . |
| 923596 | 4/1982 | Russian Federation . |
| 946650 | 7/1982 | Russian Federation . |
| 1260015 | 9/1986 | Russian Federation . |
| 1412807 | 7/1988 | Russian Federation . |
| 1620132 | 1/1991 | Russian Federation . |
| 588 301 | 5/1977 | Switzerland . |
| 1761267 | 9/1992 | U.S.S.R. . |
| 2092916 | 2/1981 | United Kingdom . |

*Primary Examiner*—Joseph J. Hail, III
*Assistant Examiner*—William Hong
*Attorney, Agent, or Firm*—Brown, Martin, Haller & McClain, LLP

[57] ABSTRACT

The present invention relates to a centrifugal grinder that comprises a body (1) with loading (2) and unloading (3) devices. The grinder comprises upper (4) and lower (5) working organs (parts) which are mounted on the body, said organs (parts) being capable of rotation in opposite directions around the vertical axis. These organs form a working chamber (6) that comprises an annular unloading aperture (7). This invention is characterized in that the upper working organ (4) is made in the shape of a hollow cone (4) while the lower working organ (5) is made in the shape of a conical disc. The conical disc (5) is mounted on the base of the hollow cone (4) and has its summit located within said hollow cone.

5 Claims, 4 Drawing Sheets

CENTRIFUGAL GRINDER

BACKGROUND OF THE INVENTION

The present invention relates to machines for crushing of solid materials, in particular, to centrifugal grinders and can be used in mining, construction, metallurgical, chemical and other branches of industry.

Meeting the industrial demands in solid materials crushing nowadays requires large amounts of energy and capital expenses. Solid materials crushing devices known from the prior art are of low efficiency.

A centrifugal grinder known in the prior art contains a body, a working part comprising a lower link with the partitions and fixed on the vertical shaft as well as an upper link, loading and unloading brunch pipes, and a mechanism of the upper link travel (SU, 946650).

A disadvantage of the known grinder is a low efficiency of crushing and high wear of the working organ elements.

A centrifugal grinder is known in the prior art containing a body with loading and unloading devices wherein upper and lower working organs are mounted, these organs being capable to rotate in opposite directions around the vertical axis forming a working chamber with an annular unloading aperture (SU, 1260015).

A disadvantage of the known grinder is a low efficiency of crushing owing to a low frequency of mutual collision of grinding material.

SUMMARY OF THE INVENTION

The aim of this invention is to create a centrifugal grinder providing a high efficiency of solid materials crushing and due to this to decrease energy requirements and capital expenses for solid material crushing.

This problem is solved by creation of a centrifugal grinder that comprises a body having a vertical axis and loading and unloading devices, upper and lower working parts which are rotatably mounted on the body for rotation in opposite directions about the vertical axis and forming between each other a working chamber with an annular unloading aperture. The upper working part has an axial loading aperture. According to the invention the said upper working part is made in the shape of a hollow cone while the lower working part is made in the shape of a conical disc, which is mounted on the base of the said hollow cone and the summit of the conical disc is located within the hollow cone.

Because the upper working part is made in the shape of a hollow cone while the lower working part is made in the shape of a conical disc and mounted on the base of a hollow cone with its summit located within the hollow cone, a zone of crushed material circulation is formed above the conical disk wherein the pieces of the material travel relatively to each other, interact with each other and are crushed by means of friction, colliding and chipping forces. As a result, an active self-crushing of the solid material occurs in the zone of circulation, and the crushing efficiency sufficiently increases.

According to another embodiment of the invention, a centrifugal grinder is provided which comprises a body with loading and unloading devices, upper and lower working parts which are mounted on the body being capable of rotation in opposite directions about the vertical axis and forming between each other a working chamber with an annular unloading aperture. The upper working part is made with an axial loading aperture. According to this embodiment of the invention, the said upper and lower working parts are made in the shape of the hollow cones oriented in opposite directions with the base of each cone adjacent and spaced from the other cone to form the annular unloading aperture.

Because the upper and lower working parts are formed as how cones with their open ends or bases facing one another, a zone is created in the working chamber wherein an active process of solid material self-crushing is going on, since by supplying the solid material due to be crushed into the working chamber that is formed by the hollow reverse cones, the pieces of material, under the influence of centrifugal forces, travel from the centre to the periphery of the working chamber, reach the inner surfaces of the cones and under the influence of the tangent constituent of the centrifugal forces travel along the conical surfaces. Counter flows of the material are formed and, in the zone of the annular unloading aperture, they create an active layer of material circulation wherein the pieces of material travel relatively to one another and interact with each other consuming accumulated kinetic energy for friction, colliding and pitching forces and are crushed. As a result an active self-crushing of solid material is going on and the efficiency of crushing sufficiently increases.

The inner surface of each cone is preferably of parabolic shape. This provides higher volume in the material circulation zone and increases homogeneity of crushing material.

DESCRIPTION OF THE DRAWINGS

This invention is explained by the following drawings where.

DESCRIPTION OF THE PREFERRED EMBODIMENTS

Figure 1:
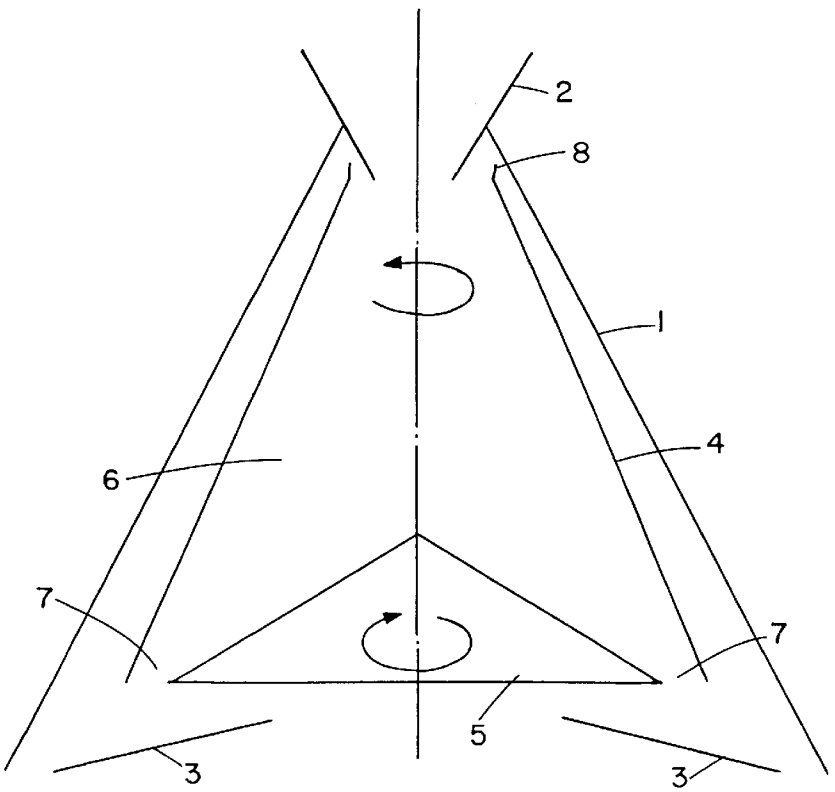
FIG. 1 shows a principal scheme of the centrifugal grinder(general view)

A centrifugal grinder comprises a body 1 with loading 2 and unloading 3 devices; and a vertical axis indicated by the dotted line in FIG. 1. The grinder has an upper working organ made in the shape of a hollow cone 4 and a lower working organ made in the shape of a conical disc 5. The hollow cone 4 and the conical disc 5 are mounted in the body 1 coaxially being capable of rotation in opposite directions about the vertical axis, and they form a working chamber 6 with an annular unloading aperture 7. The conical disc 5 is located on the base of the hollow cone 4 while the summit of the conical disc 5 is located within the hollow cone 4 and turned towards the flow of material from loading device or inlet 2. The hollow cone 4 has an axial loading aperture 8 at its apex.

The grinder works in the following way.

The material 9 (FIG. 2) to be crushed enters the working chamber 6 through the loading device 2 and rotates together with the hollow cone 4. The material particles are directed to travel into the peripheral zone under the influence of the centrifugal forces. For this travel to occur, the centrifugal forces should exceed the forces of friction and adhesion holding a particle in the surroundings of the other particles. It is known that the forces of friction and adhesion are the function of the particle surface area and they vary proportionally to it. Therefore the holding forces are proportional to this area. It is also known that the particle size is connected with the area of its surface by square law. In particular, when the diameter of the material particle increases by 2 times, its surface area rises by 4 times and, in consequence, the centrifugal forces required both to hold and to overcome them increase by 4 times. In the rotating material containing the particles of different size, the centrifugal forces on the smallest, crushed particles will be sufficient to strip them away from the larger particles so that the smallest particles will initially tend to travel outwardly to the outer periphery of the working chamber, while the centrifugal forces will be insufficient to cause the larger particles to move outwardly. Thus, a process similar to particle filtration will occur.

Figure 2:
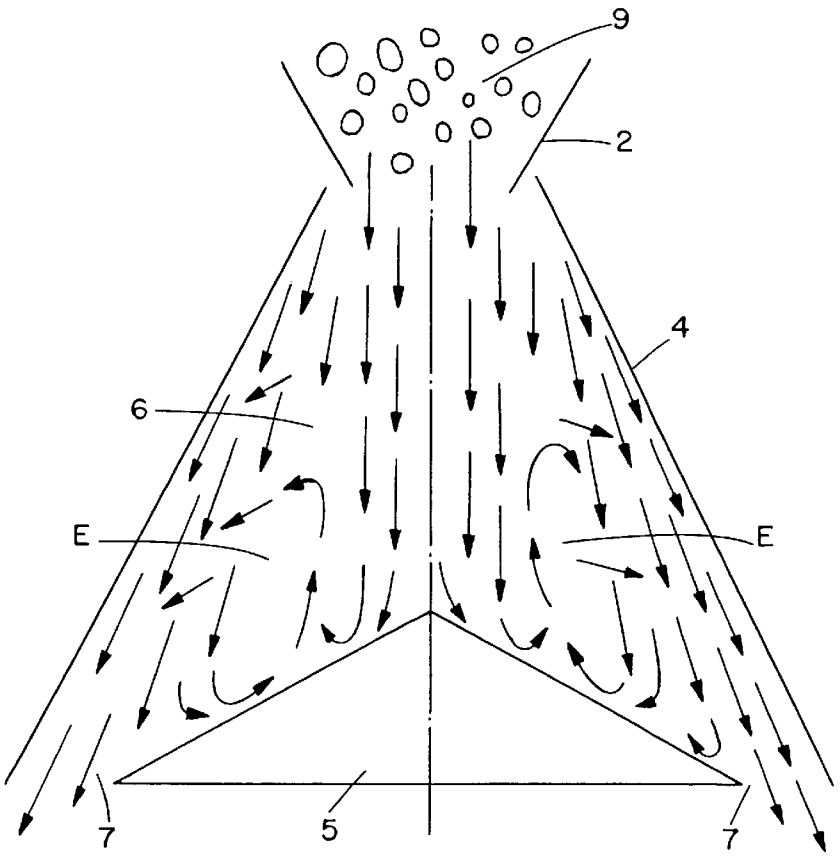
FIG. 2 shows a scheme of forming of an active zone for solid materials self-crushing.

Simultaneously with the particles redistribution according to their size and the travel of smaller particles into the peripheral zone of the rotating material under the influence of a variation in the centrifugal forces arising on the inner surface of the hollow cone 4, the material is travelling into the lower section of the working chamber 6 which is located between the hollow cone 4 and the conical disc 5. This lower section of the working chamber has a wedge shape. The smallest particles travelling along the inner surface of the hollow cone 4 exit through the loading aperture 7 and enter the unloading device 3 while the particles of non-crushed material are held in the lower wedge-shaped working chamber 6 coming across the conical disc 5. The normal constituent efforts of centrifugal forces arising on the inclined surfaces of the hollow cone 4 and the conical disc are directed towards each other and influence the particles in the lower section of the working chamber. The resultant force on the particles will tend to change the location of the particles. As the centrifugal forces approach maximum values on the constituent circle of the conical disc 5 and decrease towards the axis of its rotation in connection with the fall of the linear speed, the larger material particles which are not yet crushed, travel within the working chamber 6 from the zone of higher force into the zone of lower force, i.e. the material is forced out in the direction of expansion of wedge-shaped section of the working chamber 6. As the result, under constant material supply through the loading device 2 in the working chamber 6, counter flows arise and a zone of circulation E is formed, as illustrated in FIG. 2, wherein particles travelling in opposite directions interact and are crushed due to the friction, colliding and chipping forces. The smaller, crushed particles are forced out of the zone E under the influence of centrifugal forces as indicated by the arrows in FIG. 2.

Figure 3:
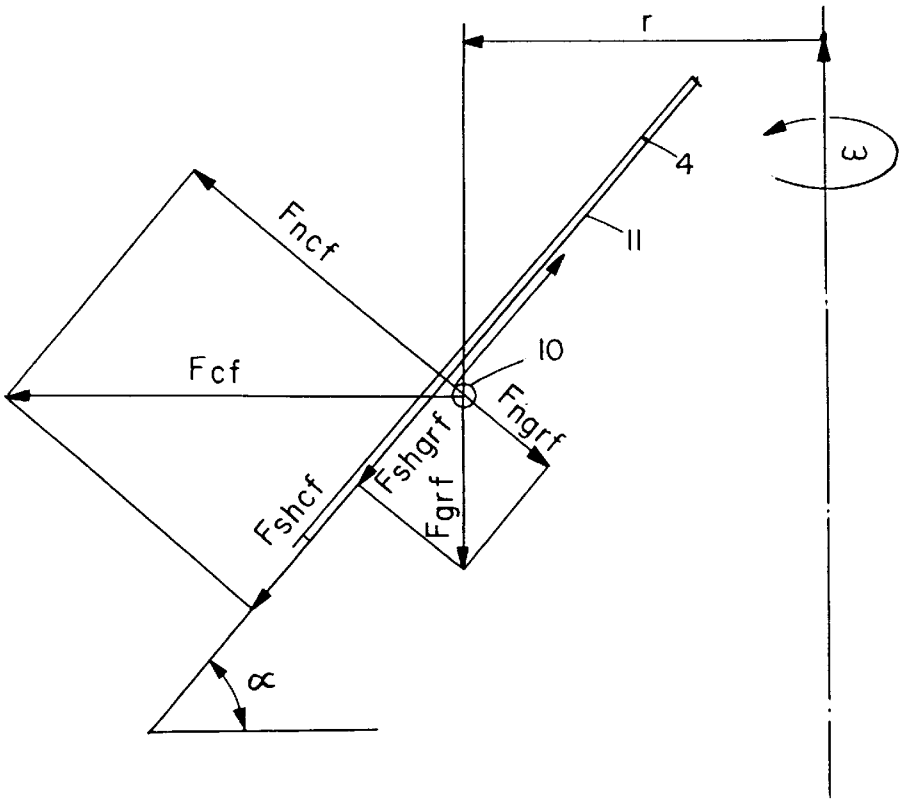
FIG. 3 shows a scheme of distribution of forces that influence on the particle of the material being on the inner surface of the rotating cone.

The angle speed of the hollow cone 4 is set up so as the efforts from the normal constituent $F_{ncf}$ of $F_{cf}$ centrifugal forces on the material particle 10 (FIG. 3) of small size, and holding it on the surface of the hollow cone 4 due to the friction forces $F_{ncf}Xf_f$ (where $f_f$ ia a friction factor of crushing material along the surface of the cone), should not exceed the summary effort from the tangent constituents $F_{shgrf}$ and $F_{shcf}$ of gravitational $F_{grf}$ and centrifugal $F_{cf}$ forces shifting the material particle 10 of predetermined, small size along the inner surface 11 of the cone 4:

$$F_{spcf}=(F_{ncf}+F_{ngrf})f_f$$

or after transformation:

$$(F_{cf}+F_{grf})\ \sin\alpha \geq F_{cf}\cos\alpha F_f$$

and $$tg\alpha \leq \frac{w^2 r+frg}{F_f w^2 r-g}$$

where W is angle speed of the cone rotation;

r is the cone radius g is the acceleration of free fall

Selection of the predetermined small particle dimension of depends on the angle speed of rotation and the angle of dip of the cone surface constituent.

Considering that $F_{grf}$=mg and $F_{cf}$=m $v^w$/2 (where m is the mass of the material particle; g is the acceleration of free fall; v is linear speed of rotation of the grinder inner surface), selection of the predetermined small particle dimension only depends on the linear speed of the cone rotation and the angle of dip of its inner surface. The size of the annular unloading aperture 7 in this case looses its determining meaning. Therefore to decrease the abrasive wear of the hollow cone 4 and of the conical disc 5, the size of the annular unloading aperture 7 is selected to be taken by 3–5 times larger than the predetermined small particle dimension.

Figure 4:
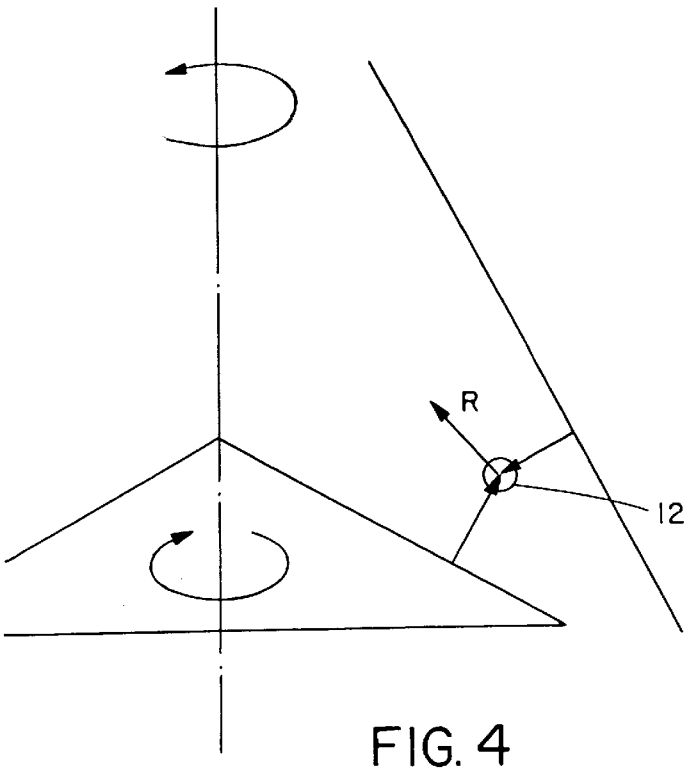
FIG. 4 shows a scheme of distribution of forces that influence on the particle of the material being in the zone of circulation.

The angles of dip of the constituents of the outer hollow cone 4 surfaces and the cone of conical disc 5 are selected so that the interaction of normal constituents of centrifugal forces on the particle 12 of the non-crushed material resulted in the effort R directed to the inside of the working chamber 6 (FIG. 4).

The angle speed of the conical disc 5 is set up so as the normal efforts arising on the inclined surface of the conical disc 5 from the centrifugal forces and effecting on the particle of non-crushed material should exceed the effort arising from the combined effect of weight, friction and adhesion forces and normal constituent of outer cone centrifugal forces.

The ratio of rotation speeds of the hollow cone 4 and of the conical disc 5 is set up so as the resulting effort effecting on the particle of non-crushed material and arising from the interaction of normal constituents of centrifugal forces should be sufficient to bring back the material inside the working chamber 6 towards the flow of the initial material and to form a zone of circulation E. To increase this ratio, the conical disc 5 is rotated in the opposite direction comparatively to the rotation direction of the hollow cone 4.

The height of the crushing zone of the working chamber 6 is selected based on physico-mechanical characteristic features of material to be crushed, and is equal to or greater than the height of the circulation zone E of non-crushed material.

Figure 5:
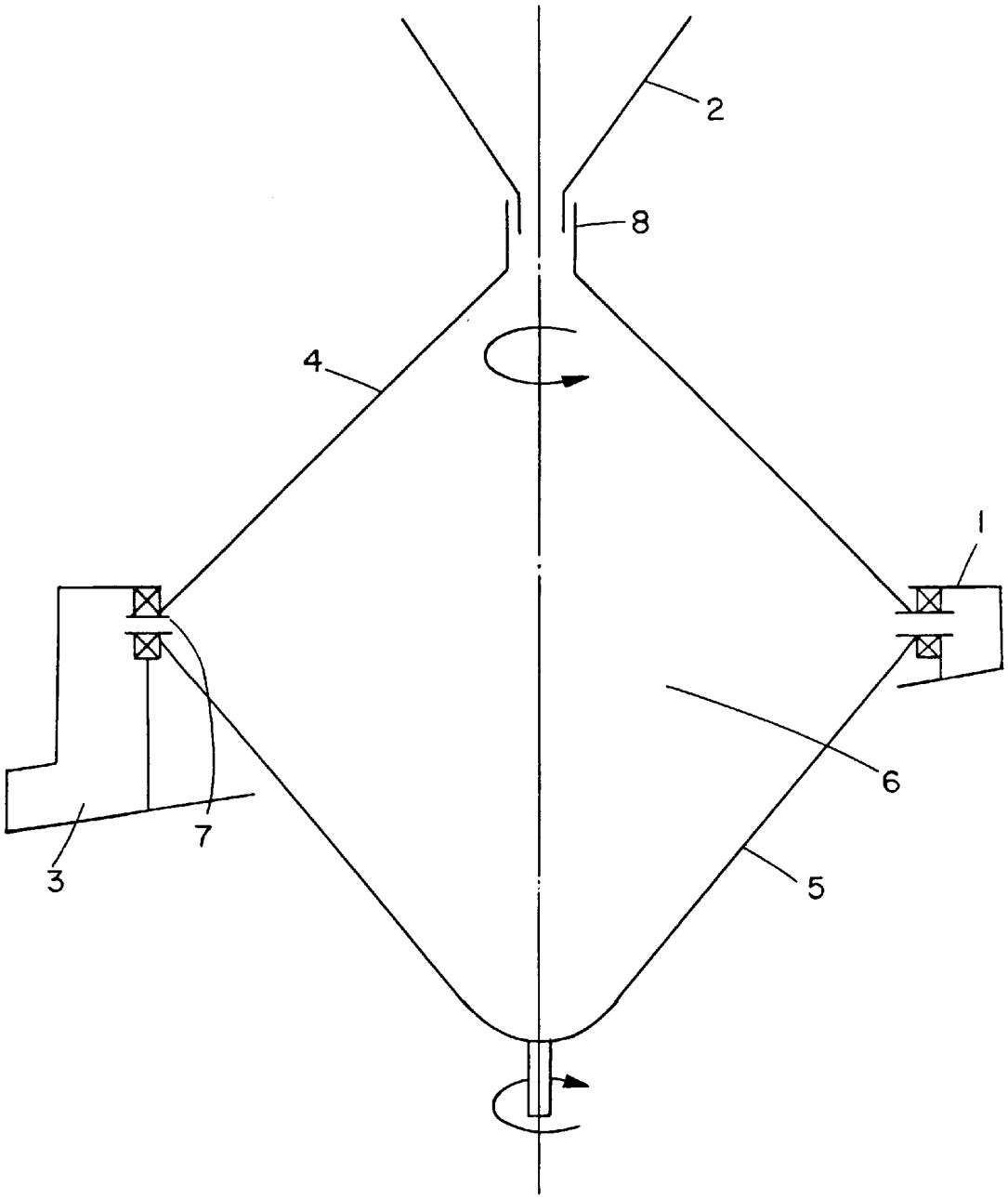
FIG. 5 shows a principal scheme of the centrifugal grinder; a general view according to the second variant.
Figure 6:
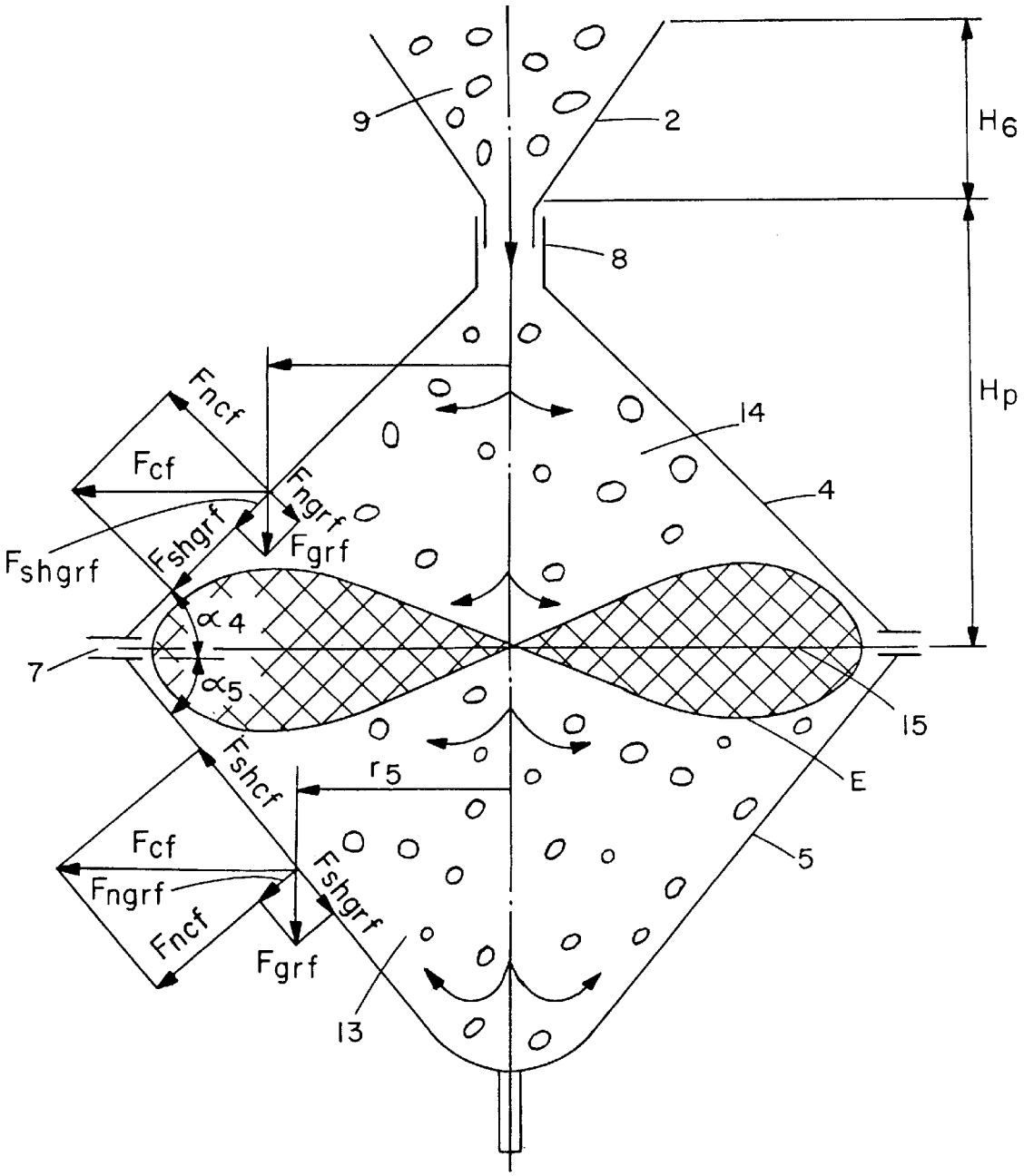
FIG. 6 shows a scheme of forming of an active zone for solid materials self-crushing according to the second variant.

According to another variant of embodiment of the invention the centrifugal grinder also comprises a body 1 (FIG. 5) with loading 2 and unloading 3 devices, upper 4 and lower 5 hollow cones mounted in the body and being capable to rotate in opposite directions around the vertical axis; the upper 4 and the lower 5 cones are oriented in opposite directions with their open bases facing and adjacent ot one another. The cones form between each other a working chamber 6 with an annular unloading aperture 7. The upper cone 4 has an axial loading aperture 8.

The grinder works in the following way.

The material 9 to be crushed (FIG. 5) under the influence of the gravitational forces enters through the loading device 2 into the working chamber 6 formed by the upper 4 and the lower 5 hollow cones rotating in opposite directions. The material enters the working chamber 6 and separated into the upper 4 and lower 5 hollow cones rotating in opposite directions and, in consequence, is separated into the parts 13 and 14 rotating in opposite directions. At the border 15 between parts 13 and 14, and active layer E is formed wherein the pieces of material travel in opposite directions, interacting with one another and being crushed as a result of friction, colliding and chipping forces. The crushed, smaller particles will rotate together with the larger, uncrushed particles. In order to move the smaller particles from the inner regions of the working chamber outwardly to the outer peripheral zone and into the unloading aperture, the centrifugal force acting on the smaller particles must be sufficient to exceed the friction and adhesion forces tending to hold the particles together. Since the centrifugal force required to move the smaller particles outwardly will be less than that required to move the larger particles, it is possible to set the centrifugal force such that only the smaller particles move out of the crushing zone, in a process similar to filtration of particles through a granular layer. The rotation of particles in opposite directions in zone E, along with the constant supply of new particles into the active layer, will produce further self-crushing and separation of the smaller, crushed particles.

The smaller, crushed particles travel into the periphery of the rotating part of the material under the influence of the centrifugal forces, reach the inner surface of the hollow cones 4 and 5 and are shifted down along the inner surface of the cone 4 and up the cone 5 and through the unloading aperture 7 are put out of the working chamber 6 under the influence of the shifting constituent of the centrifugal forces arising from the interaction of the material with the inclined cone surface.

The angle speed of the upper hollow cone 4 is set up so that the efforts of normal constituent of the centrifugal forces on small, crushed particles and holding these particles on the inner cone surface due to the forces of friction should not exceed the summary effort from the tangent constituent of gravitational and centrifugal forces shifting the particle along the inner side of the hollow cone 4 towards the unloading aperture 7, The angle speed of the lower hollow cone 5 is set up so that the summary effort from normal constituent centrifugal and gravitational forces on a small, crushed particle and holding such a particle on the inner surface of the cone due to the friction forces should not exceed the shifting effort from the tangent constituent of the centrifugal forces shifting the particle along the inner surface of the cone 5 towards the unloading aperture 7.

The maximum small particles dimension is regulated by the rotation frequency and by the angle of dip of the cones surfaces constituents.

The width of the unloading aperture is selected to be two to three times that of the selected maximum small particle dimension.

The present invention can be effectively used in the mining processing, construction, metallurgical, chemical and other industries for crushing of solid materials, since in comparison with the prior art, it provides more efficiency in crushing of solid materials due to forming of an active zone of material self-crushing. As a result the energetical and capital expenses for solid materials crushing are reduced.

We claim:

1. A centrifugal grinder, comprising:

a body having a vertical axis, a loading device and an unloading device co-axial with said vertical axis;

upper and lower working parts mounted coaxially on the body between the loading and unloading devices;

the upper and lower working parts being rotatable in opposite directions about said vertical axis;

the upper working part having an axial loading aperture aligned with said loading device and a base, and having an inner surface of hollow conical shape facing said lower working part;

the lower working part comprising a disc with a conical butt surface located completely within the hollow conical shape of said upper working part; and the inner surface of said upper working part and the conical butt surface of said lower working part defining a working chamber between said upper and lower working parts, the working chamber having an annular unloading aperture at the base of said upper working part communicating with said unloading device;

said upper working part rotating in a first direction and the lower working part rotating in a second direction opposite to said first direction as material is supplied to said working chamber from said loading device, whereby rotational motion is produced in material in said working chamber.

2. The grinder as claimed in claim 1, wherein the upper working part has a first end at said loading aperture of a first diameter, and a second, base end of circular shape and of larger diameter than said first diameter at said annular unloading aperture, the lower working part comprises a conical member with a point-like apex within said working chamber spaced between said first and second ends of said upper working part, and a circular base.

3. The grinder as claimed in claim 2, wherein the lower working part is located completely within the hollow conical shape of said upper working part, the circular base of the lower working part is aligned with the second end of said upper working part, and the annular unloading aperture is defined between the circular base of said lower working part and the second, circular base end of said upper working part.

4. A centrifugal grinder, comprising:

a body having a vertical axis, a loading device and an unloading device co-axial with said vertical axis;

upper and lower working parts mounted coaxially on the body;

the upper and lower working parts being rotatable in opposite directions about said vertical axis;

the upper working part and the lower working part each being of hollow conical shape having an apex at one end and a base of circular cross section at a second end, and the upper and lower working parts being oriented in opposite directions with the apex of the upper working part pointing in the opposite direction to the apex of the lower working part;

the upper working part having an axial loading aperture at said apex adjacent and aligned with said loading device; and the lower working part being located with its base adjacent and spaced from the base of said upper working part to form an annular unloading aperture between the bases of the upper and lower working parts.

5. The grinder as claimed in claim 4, wherein the inner surface of each cone is of parabolic shape.

* * * * *